US005494396A

United States Patent [19]

Geier et al.

[11] Patent Number: 5,494,396

[45] Date of Patent: Feb. 27, 1996

[54] COUPLING DEVICE FOR A WORK IMPLEMENT

[75] Inventors: Timothy D. Geier, Yorkville, Ill.; Kevin E. Pielmeier, Dubuque, Iowa

[73] Assignee: Caterpillar Inc., Peoria, Ill.

[21] Appl. No.: 384,638

[22] Filed: Feb. 6, 1995

Related U.S. Application Data

[63] Continuation of Ser. No. 77,986, Jun. 15, 1993, abandoned.

[51] Int. Cl.[6] ..... E02F 3/36

[52] U.S. Cl. ..... 414/723; 37/468; 403/325

[58] Field of Search ..... 414/723; 37/468; 403/408.1, 406.1, 324

[56] References Cited

U.S. PATENT DOCUMENTS

| | | | |
|---|---|---|---|
| 1,440,872 | 1/1923 | Geurink | 292/176 X |
| 2,785,916 | 3/1957 | Mutti | 292/155 X |
| 4,854,813 | 8/1989 | Degeeter et al. | 414/723 |
| 5,044,448 | 9/1991 | Lynch et al. | 414/723 X |
| 5,145,313 | 9/1992 | Weyer | 414/723 |
| 5,147,173 | 9/1992 | Fauber et al. | 414/723 |

FOREIGN PATENT DOCUMENTS

WO91/18716 12/1991 WIPO .

*Primary Examiner*—Donald W. Underwood
*Attorney, Agent, or Firm*—William C. Perry

[57] ABSTRACT

In the operation of construction machinery, it is often desirable to be able to utilize a variety of implements on a single machine. While it extremely important to be able to attach and detach these implement very quickly, many mechanisms suffer trade-offs in a variety of design parameters. The coupling device of the subject invention utilizes a locking arrangement that provides a positive coupling force upon initial engagement of the device and maintains the positive force throughout the entire operation of each work implement. All of the components in the coupling device are maintained in linear alignment with the mounting components of the machine linkage to reduce the magnitude of operational forces transmitted therebetween and to provide a device that is extremely compact and versatile in design.

12 Claims, 3 Drawing Sheets

COUPLING DEVICE FOR A WORK IMPLEMENT

This is a file wrapper continuation of application Ser. No. 08/077,986, filed Jun. 15, 1993, now abandoned.

TECHNICAL FIELD

This invention relates to a coupling device and more particularly to a coupling device that is utilized to quickly couple and uncouple a variety of work implements to a linkage arrangement of a work vehicle.

BACKGROUND ART

In the operation of construction equipment in recent years there has been a growing trend to utilize machines originally intended for a rather specific task in much more varied applications. In order to accomplish this, coupling mechanisms have been developed to allow a vehicle to mount and utilize more than one implement. For example, in the operation of a hydraulic excavator, an operator may encounter various types of soil on a single job site. When this happens, it is often necessary to change from one bucket to another or, in situations wherein rocky conditions are encountered, an entirely different implement, such as a powered hammer, may be required. In each of these situations, it is desirable to be able to detach one tool and attach the next tool and return the machine to a productive task as quickly as possible.

Several different types of quick coupling mechanisms have been utilized with varying degrees of success. One design that has achieved a great deal of success is disclosed in U.S. Pat. No. 4,854,813, issued to Robert L. Degeeter et. al. on Aug. 8, 1989. This design utilizes a wedge arrangement to couple the mounting plates of a work implement to the linkage arrangement of a work vehicle. While the wedges are arranged in linear alignment with the mounting plates and portions of the linkage arrangements, the wedges must be driven into place by means of a hammer or other suitable tool that does not maintain a positive force against the wedges while the wedges are being secured in place. This force has been known to vary somewhat and in some instances, the connection between the work implement and the linkage arrangement will loosen slightly. While this loosening is not sufficient to cause the uncoupling of the work implement, it is often necessary to re-attach the wedges to prevent their accelerated wear.

Another coupling is disclosed in U.S. Pat. No. 5,147,173, issued to Raymond L. Fauber et. al. on Sep. 15, 1992. This patent also discloses the use of a wedge to couple a linkage arrangement to a work implement. The wedge member is driven into engagement with a hydraulic actuator to maintain a positive connection at all times and has been known to work quite well. Due to the limited space that is available in the intended environment in which this coupler must operate, some of the components are arranged in a laterally offset fashion. While this is necessary to allow the design to remain compact, some forces are laterally offset from the connecting links and mounting plates. This tends to cause an uneven distribution of force applied to the wedges. It also requires many different piece parts that add to the complexity of the design and its assembly.

The present invention is directed to overcoming one or more of the problems as set forth above.

DISCLOSURE OF THE INVENTION

In one aspect of the present invention, a coupling device is provided for securing a linkage arrangement having at least one connecting link to a work implement having at least one mounting plate. The connecting link is engageable with the mounting plate in linearly aligned relationship thereto. A locking member is mounted to the connecting link in linear alignment therewith. The locking member is moveable between a first position wherein it is engaged with the respective mounting plate to secure the connecting link thereto and a second position wherein it is disengaged from the mounting plate to allow movement of the connecting link with respect to the mounting plate. An actuator is threadably engaged with the respective locking member for moving the locking member between its first and second positions upon rotation of said actuator.

In another aspect of the present invention, a coupling device is adapted for securing a work implement to a linkage arrangement. The work implement includes a pair of mounting plates and the linkage arrangement defines a pair of connecting links that are engageable with the respective mounting plates of the work implement in overlying linear alignment therewith. A pair of locking members are mounted on each of the respective connecting links in linear alignment with the respective connecting links and mounting plates. The locking members are moveable between a first position wherein the locking members are engaged with the mounting plates to secure the connecting links thereto and a second position wherein the locking members are disengaged with the mounting plates to permit relative movement between the connecting links and the mounting plates. A pair of actuators are provided that define a threaded portion that is engaged with the respective locking members. The actuators are rotatable with respect to the locking members to cause the locking members to move along said threaded portions to reposition the locking members between their first and second positions. The actuators are positioned in linear alignment with the respective locking members, the connecting links and the mounting plates.

A coupling device as set forth above, allows the locking members to be moved into contact with the hinge plates through a positive force as a result of the threaded engagement between the actuator and the locking means. The positive force urging the locking members toward their first or engaged positions is maintained during operation of the work implement, whether the initial engagement is achieved manually or with a hydraulic motor. Also, since the mounting plates, the connecting links, the locking members and the actuators are all positioned in linear alignment with one another, the operating forces are transmitted therebetween in a direct manner without amplification. The coupling device is also extremely compact and may be utilized with a linkage arrangement, such as an excavator, having very little room for clearance between the linkage components.

BEST MODE FOR CARRYING OUT THE INVENTION

Figure 1:
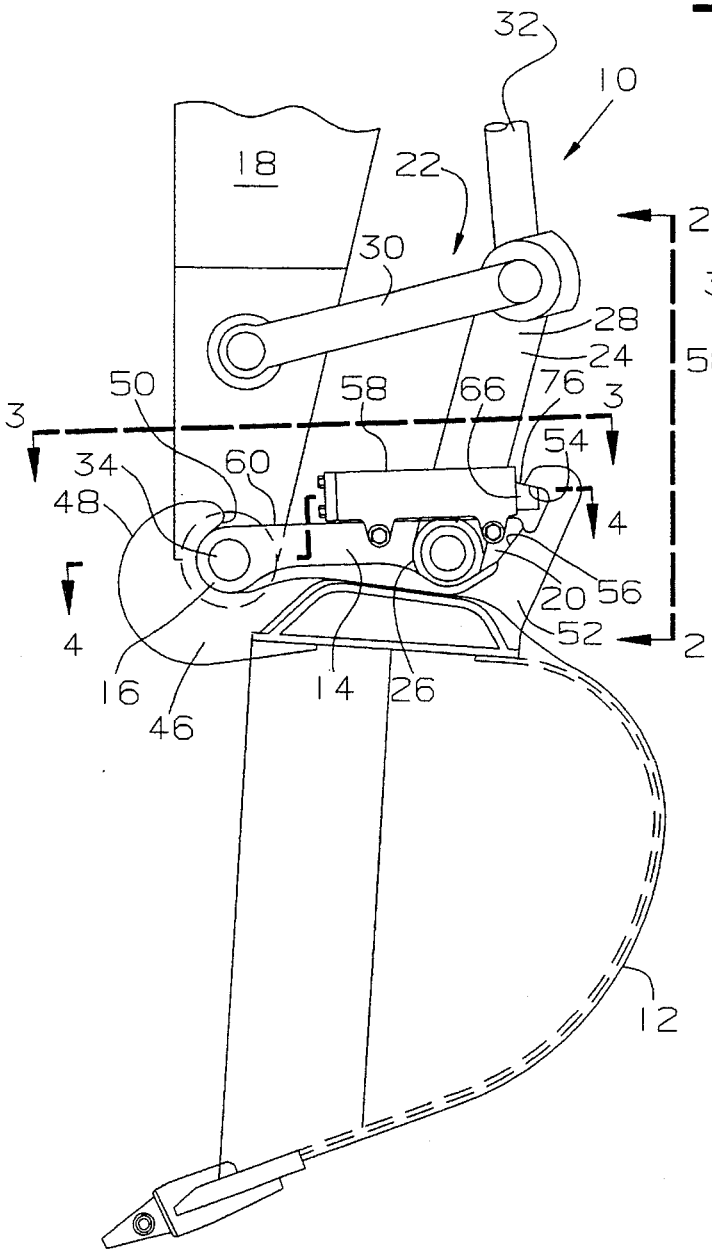
FIG. 1 is a diagrammatic side elevational view of a work implement that is coupled to the linkage of a work vehicle by a coupling device that embodies the principles of the present invention.

Referring now to the drawings, and more particularly to FIG. 1, it can be seen that a linkage arrangement 10 of a work vehicle (not shown) is secured to a work implement 12, which for purposes of illustration is shown to be a bucket. The linkage arrangement 10 includes a pair of connecting links 14 that have a first end portion 16 rotatably mounted to a main support arm 18. A second end portion 20 of the connecting links is rotatably mounted to a tilt linkage 22. The tilt linkage includes a first or power link 24 that has a first end portion 26 pinned to the second end portion 20 of the connecting links. A second end portion 28 of the power link 24 is connected to a pair of second or idler links 30. The idler links are in turn pivotally mounted to the support arm 18. A rod end 32 of a hydraulic cylinder (not shown) is pivotally connected to the connection between the power and idler links 24 and 30 respectively, and functions to impart rotation of the work implement 12 with respect to the support arm 18 when the work implement is securely in place.

Figure 3:
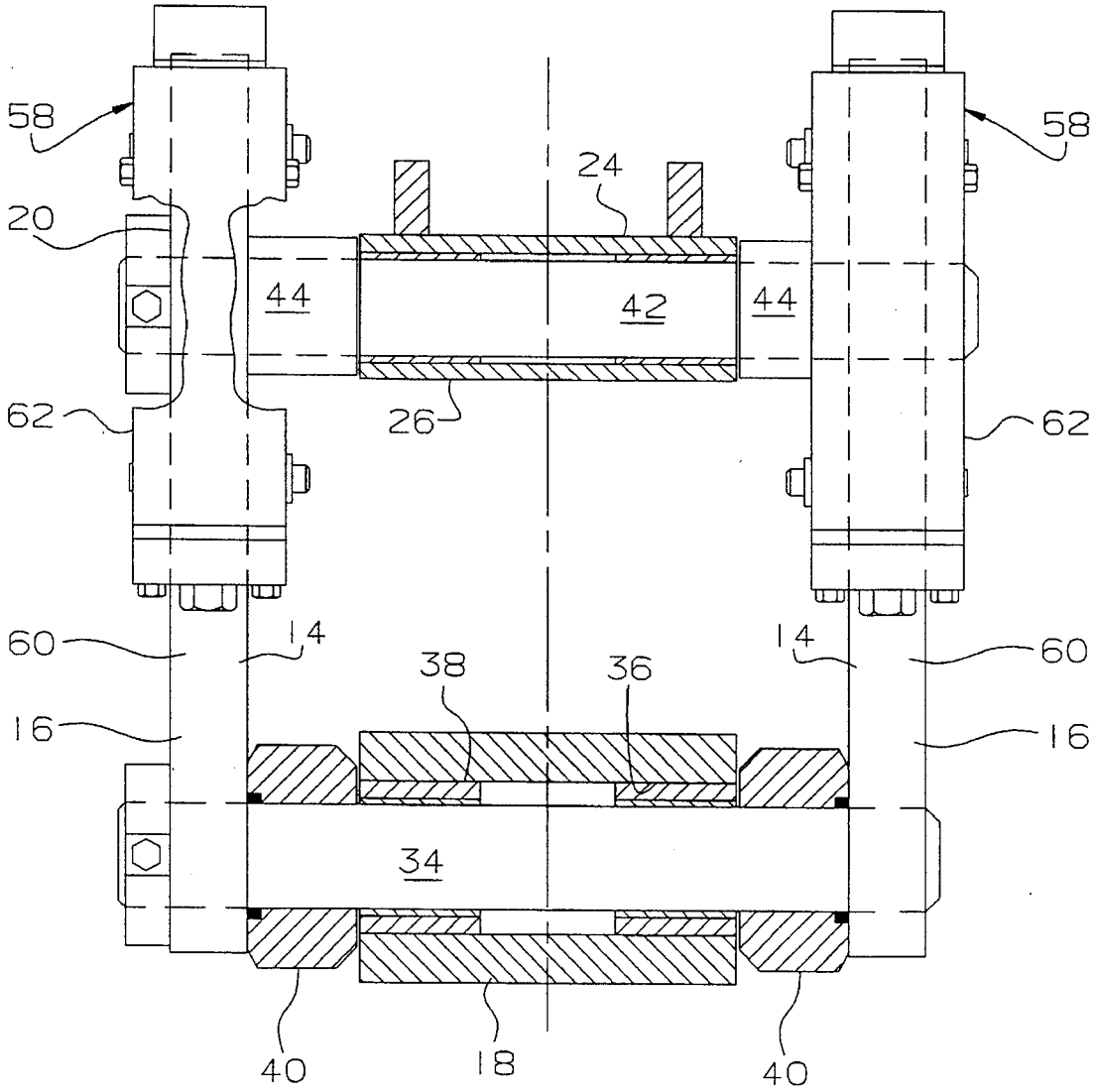
FIG. 3 is a diagrammatic top view of the coupling device taken along lines 3—3 of FIG. 1.

As can best be seen in FIG. 3, the connecting links 14 are spaced apart and are positioned on opposite sides of the support arm 18 and power link 24. A first mounting pin 34 extends through the first end portion 16 of the connecting links 14 and through a bore 36 defined in the support arm 18. A bushing 38 is pressed in the bore 36 and surrounds the mounting pin 34 to facilitate rotation between the support arm and the pin. A pair of spacers 40 is positioned between the respective connecting links and the support arm to center the support arm between the connecting links. It is to be understood that spacers may be of various widths and may be interchanged to accommodate work implements of different widths or they may be removed altogether without departing from the intent of the invention. A second pin member 42 extends between the second end portions 20 of the connection links 14 and extends through the first end portion 26 of the power link 24. A second pair of spacers 44 is utilized to center the power link 24 therebetween.

Figure 2:
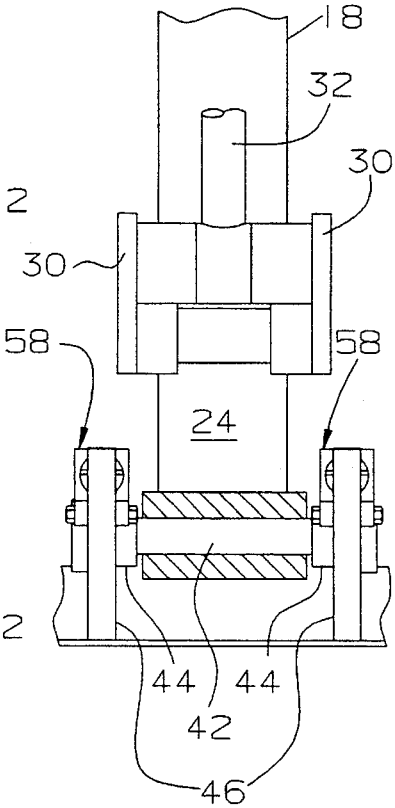
FIG. 2 is a diagrammatic partial front view invention taken along lines 2—2 of FIG. 1.

The work implement 12 defines a pair of mounting plates or hinge plates 46 on an upper portion thereof. The mounting plates are spaced from one another (FIG. 2) a distance that matches the spacing that separates the connecting links 14 and are identical in configuration. For the purpose of illustration, it is to be understood that identical components will be described using the same reference numeral for the remainder of the description. The connecting links are sufficient to engage the mounting plates 46 in overlying, linearly aligned relationship along common vertical planes 49 that are spaced apart in parallel relationship to one another. Each mounting plate has a first end portion 48 that defines a rounded receptacle 50 that is sufficient to receive the first end portion 16 of the connecting links. A second end portion 52 of each mounting plate takes the form of an upstanding flange that defines a first angled engagement surface 54 on an uppermost end portion and a second angled surface 56 that is positioned beneath and slightly to the rear of the first engagement surface 54. The second angled surface 56 is positioned for engagement with the second end portion 20 of the connecting links 14.

A locking arrangement 58 is mounted to an upper portion 60 of each connecting link 14. Each locking arrangement includes a housing 62 that defines an internally disposed cavity 64. A locking member 66, which in the present instance is shown to be a wedge, is positioned within the cavity 64 for reciprocation between a first position and a second position with respect to the housing. The locking member 66 has a first end portion 68 that defines a threaded bore 70. The threaded bore 70 forms a closure for an axially directed blind bore 72 positioned within the locking member. A second end portion 74 of the locking member 66 defines an angled engagement surface 76. When the locking member is in its first position, it is moved outwardly from the housing 62 a distance that is sufficient to move the angled engagement surface 76 into engagement with the first angled surface 54 of the mounting plate 46. When the locking member is in its second position, the angled surface 76 is moved out of engagement with the first angled surface 54 of the mounting plate to a position within the housing 62. A pair of axially extending slots 78 are defined in a pair of the sidewalls 80 and 82 of the locking member. Each slot 78 terminates at an outwardly directed flange 84 that defines a rearwardly directed abutment face 86. The flange 84 has a diameter that is large enough to contact an inwardly directed shoulder 88 defined by the housing to limit the travel of the locking member 66 toward its first position. Each slot 78 receives a projection 90 defined on a guide member 92 that is threadably received in opposite sides 94 and 96 of the housing. The guide members 92 prevent the locking member 66 from binding contact with the housing 62 as it moves between its first and second positions.

An actuator 98 in the form of a rod member is positioned within the cavity 64 and includes a first or head end portion 100. The first end portion 100 is captured with an endcap 102 that is secured to the housing 62 by any suitable means such as bolts 104. The endcap 102 defines a stepped bore that receives the first end portion 100 of the rod member 98 in a manner to permit relative rotation of the rod member with respect to the endcap and the remainder of the housing 62. The stepped bore defines a first portion 106 that receives a cylindrical portion 108 defined on the first end portion 100 of the rod member. An enlarged flange portion 110 is formed on the rod member inwardly of the cylindrical portion 106 and is disposed within a first counterbore 112 defined by the stepped bore. The first counterbore 112 has a diameter larger than that of the first portion 106 of the stepped bore and an axial length greater than that of the enlarged flange 110 to allow the flange a limited amount of axial movement within the first counterbore 112. A radially directed end face 114 extends between the first portion 106 of the stepped bore and the first counterbore 112. The end face 114 forms an abutment surface for the flange 110 to limit its travel within the first counterbore 112 in the rearward or leftward direction as viewed in the drawings. A second counterbore 116 is defined by the stepped bore and opens onto an inner face 118 of the endcap. A bearing member 120 is positioned within the second counterbore 116 and is disposed about the rod member 98. The bearing is sandwiched between the enlarged flange 110 and a thrust plate 122 that is located between the inner face 118 of the endcap and the housing 62. The bearing member 120 facilitates relative rotation between the rod member and the housing. A hexagonally shaped head 124 extends outwardly from the cylindrical portion 108 to a position outside the confines of the endcap where it is free for engagement by a tool such as a wrench.

The rod member 98 further defines a second end portion 126 that has a plurality of threads formed thereon. The second end portion 126 of the rod member 98 is threadably engaged with the first end portion 68 of the locking member 66 and is extendable into the blind bore 72. The length of the blind bore 72 is sufficient to receive enough of the second end portion 126 of the rod member to allow the locking member 66 to be moved entirely within the housing 62 upon rotation of the rod member.

A spring member 128 is positioned within the internal cavity 64 defined by the housing 62 and has first end portion 130 that bears against the thrust plate 122 and a second end portion 132 that bears against the locking member 66. The spring member 128 is concentrically disposed about the rod member 98 and applies a force against the locking member to bias it toward it's first position.

Figure 5:
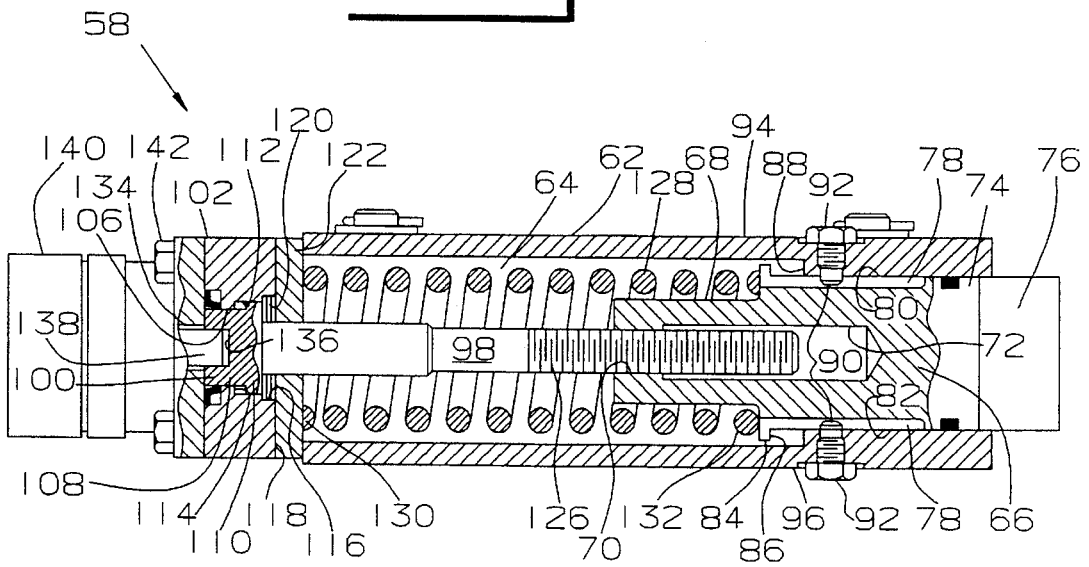
FIG. 5 is an enlarged diagrammatic sectional view of an alternate embodiment of the coupling device.

With reference to FIG. 5, an alternate locking arrangement will be described. The alternate actuator is basically identical to that previously described except in the region of the first end portion 100 of the rod member 98. Instead of having a hexagonal head 124 extending from the cylindrical portion 108, the cylindrical portion defines a radially extending planar surface 134. A receptacle or socket 136 is formed in the planar surface 134 and is sufficient for receiving a drive shaft 138 of a hydraulically driven motor 140 that may be mounted to the endcap 102 by bolts 142. The socket may be of any suitable shape that is compatible with that of the motor shaft 138. The hydraulic motor is driven in customary fashion, with the delivery of pressurized fluid through a pair of hydraulic hoses (not shown) and may be controlled from the cab by the operator.

INDUSTRIAL APPLICABILITY

Figure 4:
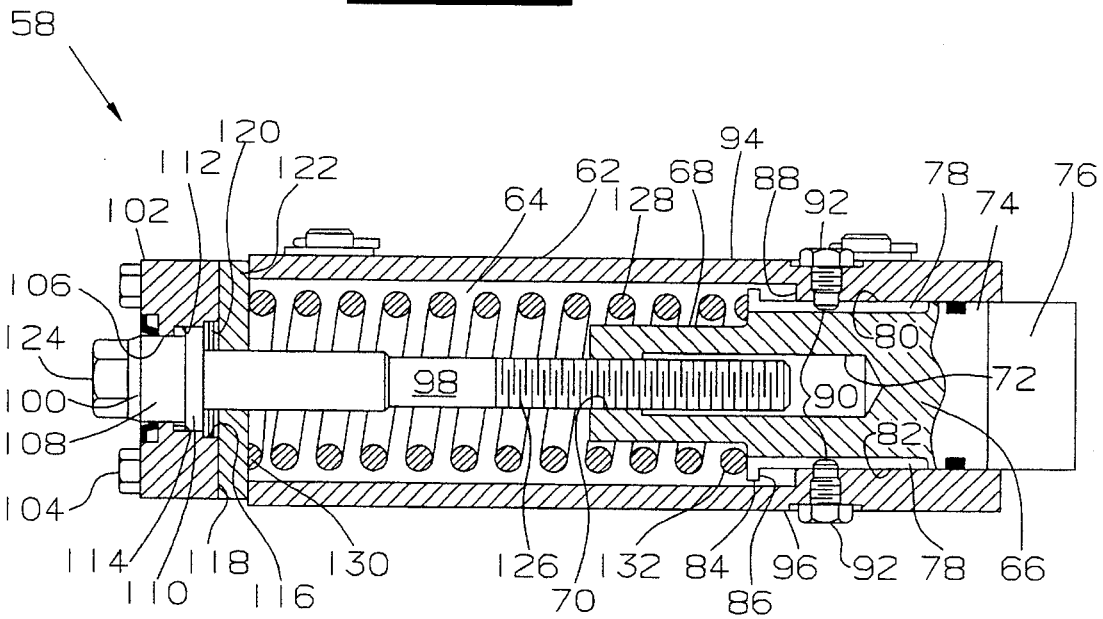
FIG. 4 is an enlarged diagrammatic sectional view of the coupling device taken along lines 4—4 of FIG. 1.

When coupling an implement to a linkage arrangement 10 of a vehicle, the first end portions 16 of the connecting links 14 are positioned within the receptacles 50 defined in the mounting plates 46. When the first end portions of the connecting links are so nested, the hydraulic cylinder is actuated to extend the cylinder rod 32 and rotate the linkage arrangement 10 with respect to the implement, or in a clockwise direction as viewed in FIG. 1. The linkage arrangement is rotated until the second end portions 20 of the connecting links 14 are brought into contact with the second angled surface 56 defined by the mounting plates 46. When proper positioning has been achieved between the implement and the linkage arrangement, the operator may then engage the hexagonally shaped head 124 of the rod member 98 shown in FIG. 4, with an appropriate wrench or socket, and rotate the rod member in a clockwise direction. As the rod member is rotated, the threaded engagement with the second end portion 74 of the locking member 66 causes the locking member to be moved along the length of the rod member. As this occurs, the locking member is moved from its second position within the confines of the housing 62, to its first position wherein the angled engagement surface 76 is brought into contact with the first angled engagement surface 54 defined by the mounting plates 46. Rotation of the rod member will continue until the enlarged flange 110 is brought into firm engagement with the radially extending end face 114 defined in the endcap 102 to create a solid link between the end face 114 and the mounting plate. Since the locking member is under a considerable load as applied by the spring 128, the bearing member 120 is positioned on the spring side of the enlarged flange to aid in the rotation of the rod member. The force that is generated from the engagement between the angled engagement surface 76 of the locking member and the first angled surface 54 of the mounting plates 46 is translated rearwardly by the engagement of the second end portions 20 of the connecting links 14 with the second angled surface 56 of the mounting plates. The combined resultant of forces maintains the first end portions 16 of the connecting links in firm engagement with their respective receptacles 50.

As the implement 12 is utilized, extremely high operational forces will be transmitted between the components and a certain amount of wear between the angled surfaces 76 and 54 of respective locking members and mounting plates will naturally occur. As this happens, the solid link provided by the rod member 98 and locking member 66 between the end face 114 and the mounting plate 46 will tend to be diminished. Compensation for this wear will occur automatically with each implement change. In the event that the same implement is utilized for a prolonged period of time, the spring member 128 is positioned to bias the locking member 66 toward its first or engaged position to maintain a positive force behind the locking member. The spring member will provide compensation for the wear until the enlarged flange 110 comes in contact with the thrust plate 122. At this point in time, the operator will be able to feel any additional wear during the operation of the implement. In order to restore the coupling to its original clamping force, the rod member may be rotated to a point wherein the enlarged flange member 110 is again brought into engagement with the end face 114. When this adjustment is made, it can be seen that the distance between the abutment face 86 defined by the outwardly directed flange 84 of the locking member 66 and the inwardly directed shoulder 88 of the housing 62 is reduced. This adjustment may be made several times before the outwardly directed flange 84 is brought into contact with the shoulder 88. When this situation occurs, the coupling device will not be able to be engaged without a small amount of "play" occurring between the implement 12 and the linkage arrangement 10 and and serves to indicate that rebuilding of the first angled surface 54 will be required.

When uncoupling of the implement 12 is desired, the head 124 of the rod member 98 is again engaged by a wrench or socket and rotated in a counterclockwise direction. As a result, the locking member 66 is moved along the threaded end portion 126 of the rod member to it's second position wherein it is positioned entirely within the housing 62. This will allow the rotation of the linkage arrangement 10 with respect to the implement 12 and the disengagement of the connecting links 14 with the mounting plates 46 of the implement.

When it is desirable to operate the actuator 98 automatically from within the cab of a vehicle, the locking arrangement 58 is readily adaptable to include a hydraulic motor 140 as disclosed in FIG. 5. The operator need only control the direction of rotation of the hydraulic motor from the cab of the vehicle by one of any number of commonly known control mechanisms. The shaft 138 of the motor is received within a complimentary shaped socket 136 defined in the cylindrical portion 108 of the rod member 98 to transmit rotation of the motor to the rod member to achieve engagement between the linkage arrangement and the implement in a manner exactly as described above.

With a coupling device as set forth above, a positive coupling force between the linkage arrangement 10 and the implement 12 may be achieved and continually maintained. The screw-thread engagement between the actuator and the locking member achieve the initial locking force while the spring member 128 maintains the force and compensates for wear as the implement is operated. In addition, since all of the components are in linear alignment with each other, so to is the transmission of forces therebetween. By avoiding any offset in the alignment of the components during initial engagement or in the maintenance thereof, amplification of the forces is avoided. This enables the components to remain relatively small which is essential since the area available in which to position a coupling device is extremely compact. Finally, the versatility of the coupling device is greatly enhanced by allowing the actuation to be accomplished in either a manually or an automatic mode. Since the components remain substantially identical with the exception of the hydraulic lines and the motor, change from one actuating mode to another may be accomplished very easily without a great deal of expense, additional components, or downtime.

Other aspects, objects and advantages of this invention can be obtained from a study of the drawings, the disclosure and the appended claims.

We claim:

1. A coupling device adapted for securing a work implement having at least one mounting plate to a linkage arrangement comprising:

at least one connecting link defined by the linkage arrangement and being engageable with the mounting plate in linear alignment therewith along a substantially vertical plane;

a housing having a stepped bore that defines a radially directed end face and a thrust plate mounted in axially spaced relationship to the end face, said housing being mounted in linear alignment to the respective connecting link along the vertical plane;

a locking member mounted within the housing along the vertical plane, said locking member being moveable between a first position wherein the locking member is engaged with the respective mounting plate to secure the connecting link thereto and a second position wherein the locking member is disengaged from the mounting plate to allow movement of the connecting link with respect thereto;

an actuator having an enlarged flange and being threadably engaged with the respective locking member for moving said locking member between its first and second positions upon rotation of said actuator, said actuator being axially aligned with the locking member and positioned along the vertical plane with the enlarged flange located within the housing between the radially directed endface and the thrust plate;

means for biasing the enlarged flange of the actuator for movement between the radially directed end face and the thrust plate toward the first position of the locking member as a result of wear incurred by the locking member, said biasing means being positioned between the housing and the locking member and concentrically about the actuator; and an abutment means provided between the locking member and the housing to indicate the need for service of the locking member.

2. A coupling device as set forth in claim 1 wherein the actuator further includes a bolt member having a first end portion that is secured to the housing for rotation relative thereto and a threaded end portion that is engaged with a first end portion of the locking member whereupon rotation of the rod member with respect to the locking member causes reciprocation of the locking member within the housing.

3. A coupling device as set forth in claim 2 wherein the first end portion of the actuator defines a hexagonal portion that is sufficient for engagement with a wrench.

4. A coupling device as set forth in claim 1 wherein the actuator further includes:

a rod member having a first end portion secured to the housing for rotation with respect thereto and a second end portion that is threadably engaged with a first end portion of the locking member; and a hydraulic motor secured to the housing and engaged with the first end portion of the rod member to provide rotation of the rod member and reciprocation of the locking member within said housing.

5. A coupling device adapted for securing a work implement having a pair of mounting plates defined thereon, to a linkage arrangement, comprising:

a pair of connecting links defined by the linkage arrangement, each of said connecting links being engageable with the respective mounting plates of the work implement along a generally vertically oriented plane in overlying linear alignment therewith;

a pair of housings, each having a stepped bore that defines a radially directed end face and a thrust plate mounted in axially spaced relationship to the end face, each housing being mounted in linear alignment to one of the respective connecting links along the respective vertical planes;

a pair of locking members mounted within the respective housings and being moveable between a first position wherein the locking members are engaged with the mounting plates to secure the connecting links thereto and a second position wherein the locking members are disengaged with the mounting plates to permit relative movement between the connecting links and the mounting plates;

a pair of actuators defining a threaded portion and an enlarged flange, said threaded portion being engaged with respective locking members, said actuators being rotatable with respect to the locking members to cause the locking members to move along said threaded portions to reposition the locking members between their first and second positions, said actuators being positioned with the enlarged flange within the stepped bore for movement between the endface and thrust bearing and being positioned in axial alignment with the respective locking members along the respective vertical planes;

means for biasing the enlarged flanges of the respective actuators for movement between the endface and the thrust bearing of the respective housings as a result of wear incurred by the locking member, said biasing means being positioned between the housing and the locking member and concentrically about each of the respective actuator; and an abutment means provided between the locking member and the housing to indicate the need for service of the locking member.

6. A coupling device as set forth in claim 5 wherein the actuators are each further defined by a rod member having a first end portion having a hexagonally shaped portion that is engageable with a wrench to provide rotation of said rod member.

7. A coupling device as set forth in claim 5 wherein the actuators are each further defined by a rod member having a first end portion engaged with a hydraulic motor and a second end portion threadably engaged with the locking member, said hydraulic motor being sufficient to rotate the rod member.

8. A coupling device as set forth in claim 1 wherein the biasing means urges the enlarged flange toward engagement with the thrust plate to maintain contact between the locking member and the mounting plate in absence of rotation of the actuator.

9. A coupling device as set forth in claim 1 wherein the abutment means includes:

an inwardly directed shoulder defined by the housing in close proximity to the locking member;

an outwardly directed flange defined on the locking member along a portion thereof that is positioned within the housing, said flange being of a diameter sufficient to engage the inwardly directed shoulder defined by the housing to provide a maximum position of travel of the locking arrangement toward its first position.

10. A coupling device, comprising:

a work implement having at least one mounting plate having a first end portion defining a receptacle and a second end portion defining an upstanding flange, said upstanding flange having first and second engagement surfaces defined thereon;

a linkage arrangement having at least one connecting link having first and second end portions, said connecting link being positioned for engagement with the mounting plate of the work implement with the first end portion thereof engaged with the first end portion of the mounting plate and the second end portion thereof engaged with the second engagement surface of the mounting plate, said connecting link and mounting plate being positioned in linear alignment with one another along a substantially vertically extending plane;

a housing having a stepped bore that defines a radially directed end face and a thrust plate mounted within the housing in axially spaced relationship to the end face, said housing being mounted in linear alignment to one of the respective connecting links along the respective vertical planes;

a locking member mounted within said housing, said locking member being moveable between a first position wherein the locking member is engaged with the first engagement surface of the mounting plate to secure the connecting link thereto and a second position wherein the locking member is disengaged from the first engagement surface to allow movement of the connecting link with respect thereto;

an actuator defining a threaded portion and an enlarged flange, said threaded portion being engageable with the locking member and being rotatable with respect to the locking member to cause the locking member to move along said threaded portion to reposition the locking member between its first and second positions, said actuator being positioned with the enlarged flange within the stepped bore for movement between the endface and thrust bearing and being positioned in axial alignment with the locking member along the vertical plane;

means for biasing the enlarged flange of the actuator for movement between the endface and the thrust plate, said movement occurring with the locking member as it moves toward its first position as a result of wear incurred by the locking member and in absence of rotation of the actuator, said biasing means being positioned along the vertical plane between the housing and the locking member; and an abutment means provided between the locking member and the housing to indicate the need for service of the locking member.

11. A coupling device as set forth in claim 10 wherein the first engagement surface defined by the mounting plate is an angled surface that engages an angled surface defined by the locking member to form a wedging force therebetween.

12. A coupling device as set forth in claim 11 wherein the second engagement surface is an angled surface that engages the second end portion of the connecting link in a manner to transmit the wedging force created by the engagement between the angled surface of the locking member and the first engagement surface of the mounting plate, toward the first end portion of the connecting link to increase the engagement force applied between the first end portion of the connecting link and the mounting plate.

* * * * *